US008835817B2

(12) United States Patent
Sundberg

(10) Patent No.: US 8,835,817 B2
(45) Date of Patent: Sep. 16, 2014

(54) HEATING UNIT COMPRISING A HEAT RESISTANCE ELEMENT SHAPED AS A CONDUCTIVE PATTERN

(75) Inventor: Mats Sundberg, Västerås (SE)

(73) Assignee: Sandvik Intellectual Property AB, Sandviken (SE)

( * ) Notice: Subject to any disclaimer, the term of this patent is extended or adjusted under 35 U.S.C. 154(b) by 1209 days.

(21) Appl. No.: 12/311,549

(22) PCT Filed: Sep. 6, 2007

(86) PCT No.: PCT/SE2007/050629

§ 371 (c)(1),
(2), (4) Date: Aug. 6, 2009

(87) PCT Pub. No.: WO2008/044987

PCT Pub. Date: Apr. 17, 2008

(65) Prior Publication Data

US 2009/0302028 A1 Dec. 10, 2009

(30) Foreign Application Priority Data

Oct. 9, 2006 (SE) ..... 0602119

(51) Int. Cl.
*H05B 3/16* (2006.01)
*H05B 3/14* (2006.01)
*H05B 3/26* (2006.01)

(52) U.S. Cl.
CPC ..... *H05B 3/265* (2013.01); *H05B 2203/011* (2013.01); *H05B 3/143* (2013.01); *H05B 2203/003* (2013.01); *H05B 2203/013* (2013.01); *H05B 2203/037* (2013.01)
USPC ..... 219/544

(58) Field of Classification Search
USPC ..... 219/465.1, 542, 544
See application file for complete search history.

(56) References Cited

U.S. PATENT DOCUMENTS

| | | | | |
|---|---|---|---|---|
| 6,535,371 | B1 | 3/2003 | Kayamoto et al. | |
| 7,547,407 | B2 | 6/2009 | Matsuda et al. | |
| 7,564,008 | B2 | 7/2009 | Mori et al. | |
| 2003/0150563 | A1 * | 8/2003 | Kuibara et al. | 156/345.51 |
| 2006/0194688 | A1 * | 8/2006 | Sundberg et al. | 501/87 |

FOREIGN PATENT DOCUMENTS

EP 1156498 11/2001

(Continued)

OTHER PUBLICATIONS

Office Action for Swedish Patent Application No. 0602119-0, dated Apr. 18, 2007.

(Continued)

*Primary Examiner* — Ori Nadav
(74) *Attorney, Agent, or Firm* — Morgan, Lewis & Bockius LLP

(57) ABSTRACT

A heating unit with a resistive element formed as a conducting pattern, which resistive element is bound to a substrate, such as a base plate, on which the resistive element is extended, and which resistive element is arranged to be placed under the influence of an electrical voltage. The invention is wherein the resistive element and the said base have the same or essentially the same coefficients of thermal expansion, and in that the resistive element has been bound to the substrate by sintering.

10 Claims, 3 Drawing Sheets

(56) References Cited

FOREIGN PATENT DOCUMENTS

Figure 1:
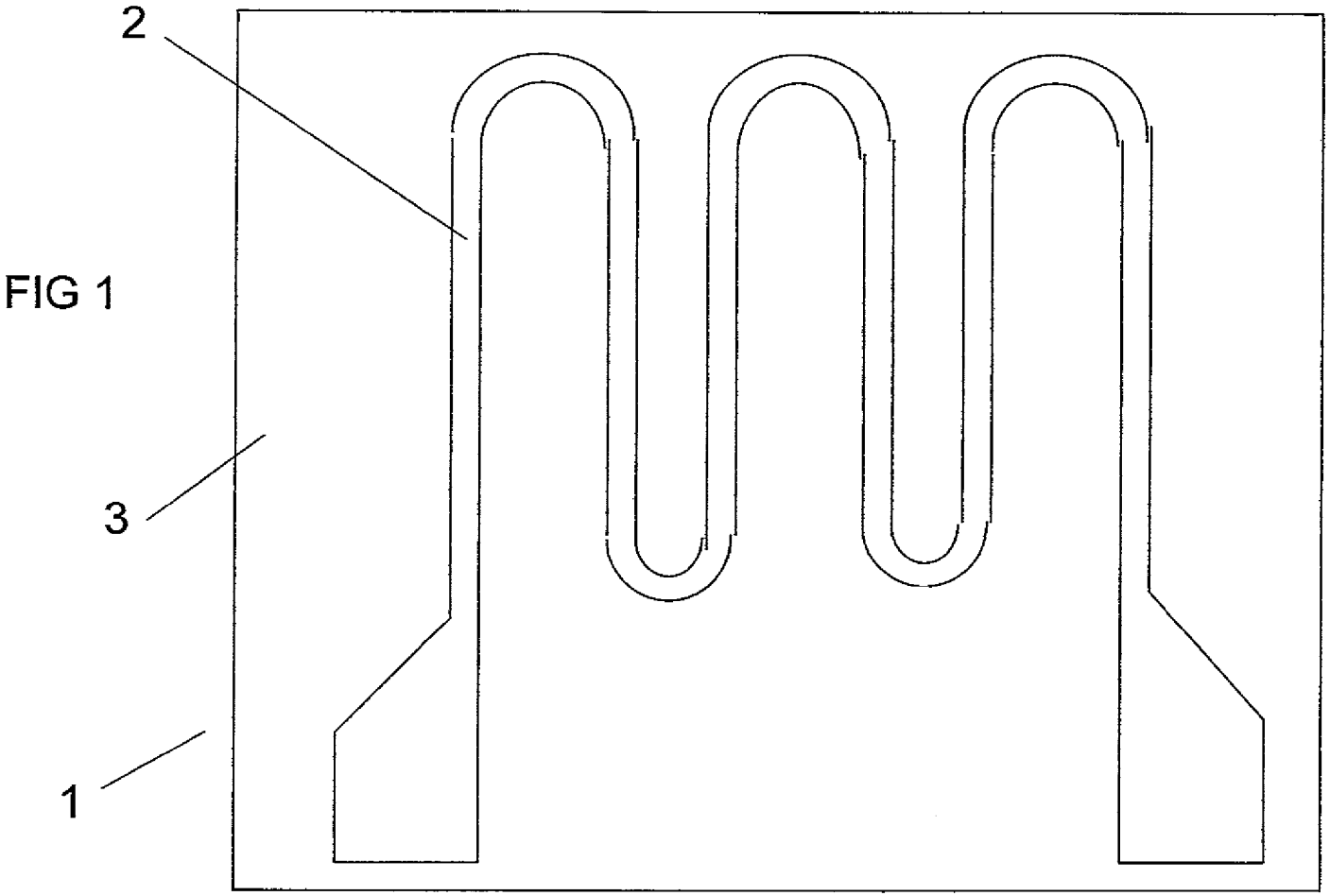

| | | |
|---|---|---|
| EP | 1248293 | 10/2002 |
| EP | 1 602 635 | 12/2005 |
| EP | 1 672 679 | 6/2006 |
| KR | 2003-0007958 | 1/2003 |
| KR | 10-2005-0110625 | 11/2005 |
| KR | 10-2006-0049532 | 5/2006 |
| KR | 10-2006-0067832 | 6/2006 |
| WO | WO 2004/069745 | 8/2004 |

OTHER PUBLICATIONS

Notice of Grounds for Rejection (with English translation) for Korean Patent Application No. 2009-7007271, dated Oct. 31, 2013.
Office Action, dated Apr. 22, 2014 with European search report dated Apr. 8, 2014 for European Patent Application No. 07808866.3-1808.
Barsoum et al., Thermal and Electrical Properties of $Nb_2AIC$, $(Ti, Nb)_2AIC$ and $Ti_2AIC$ *Metallurgical and Materials Transactions A* vol. 33, No. 9, Sep. 2002 pp. 2775-2779.

* cited by examiner 2
3

2
4
3

6
2
2
7
5
4
3

HEATING UNIT COMPRISING A HEAT RESISTANCE ELEMENT SHAPED AS A CONDUCTIVE PATTERN

The present invention relates to a heating unit with a heating element in the form of a resistive element formed as a conducting pattern.

Heating elements in the form of a loop with a conducting, pattern in order to emit heat as evenly as possible over a surface, for example, are available. Such a heating element is also available bound by means of lamination to a base, since such a heating element is often very thin and has for this reason poor mechanical strength. In general, the element is attached, or bound, to a substrate, in the form of, for example, a base plate that is arranged to support the object that is to be heated. The heating element is heated by causing an electric current to flow through the element.

It is an advantage in certain cases if such heating elements are divided into several independent heat zones that can be individually controlled. This is important during, for example, the heat treatment of for example silicon discs so called Si wafers, where a very even temperature is required across the heated substrate. This requires also good thermal contact between substrate and conductors in order to achieve a rapid response time.

One problem with such heating units that comprise a resistive element laid in a pattern on the base plate is that tension is formed in the heating unit when it is heated and cooled, and when the heating unit has a temperature that differs from the temperature at which the joint between the resistive element and the base plate was formed.

Such tension results in the formation of cracks in the heating unit, and the heating unit subsequently breaks after a certain period in use.

Furthermore, it is required in certain applications that the resistive element be exposed to oxidising environments.

Various refractory metals, such as W, Mo, Ta, Pt and Pd, have for example traditionally been used. The disadvantage of W, Mo and Ta is their limited resistance to oxidation, which limits the temperature at which they can be used in oxidising and corrosive environments. A circuit pattern in W, for example, on a base plate of $Al_2O_3$ in an air atmosphere cannot be used at temperatures greater than a few hundred degrees. Pt, Pd and other inert, noble metals are prohibitively expensive in many contexts.

The present invention offers such a heating unit with a resistive element formed as a conducting pattern that gives good adhesion to the base plate and a long lifetime for the heating unit.

The present invention, thus, relates to a heating unit with a resistive element formed as a conducting pattern, which resistive element is bound to a substrate, such as a base plate, on which the resistive element is extended, and which resistive element is arranged to be placed under the influence of an electrical voltage, and it is characterised in that the resistive element and the said base have the same or essentially the same coefficients of thermal expansion, and in that the resistive element has been bound to the substrate by sintering.

Figures 2, 3, 4A:
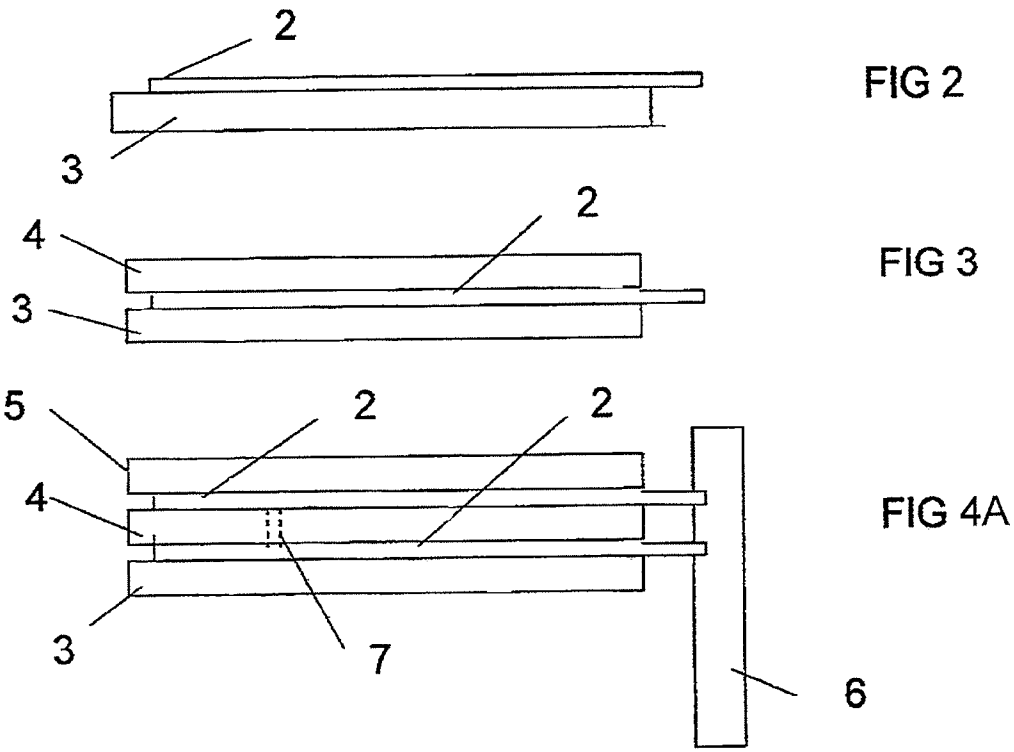
Figure 4B:
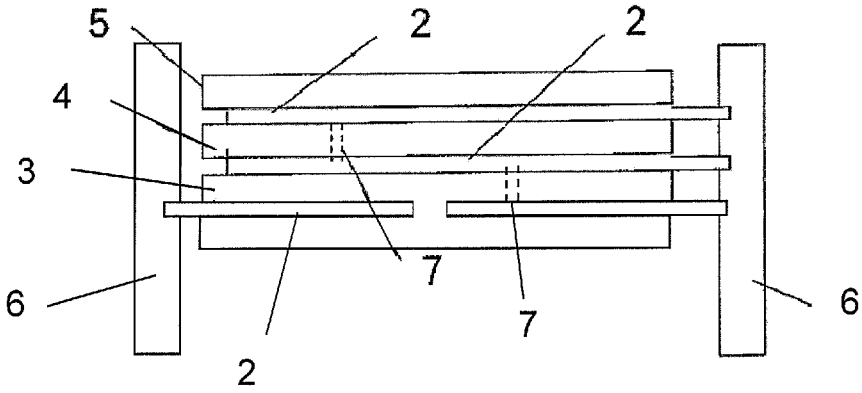
Figure 4C:
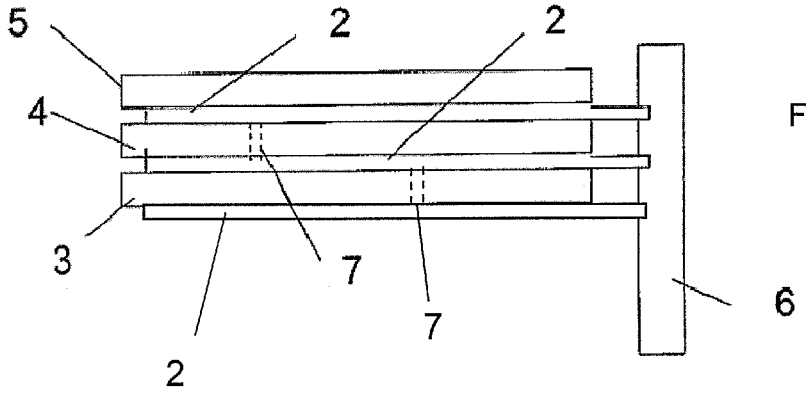

The invention will be described in more detail below, partly in association with embodiments of the invention shown in the attached drawings, where FIG. 1 shows an example of a heating unit with a resistive element that has a conducting pattern, seen from above, FIG. 2 shows schematically in cross-section a first embodiment of a heating unit according to the invention, FIG. 3 shows schematically in cross-section a second embodiment of a heating unit according to the invention, FIG. 4A shows schematically in cross-section a third embodiment of a heating unit according to the invention, FIG. 4B shows schematically in cross-section a further embodiment of a heating unit according to the invention, and FIG. 4C shows schematically in cross-section a still further embodiment of a heating unit according to the invention.

The present invention relates to a heating unit 1 with a resistive element 2 formed as a conducting pattern, which resistive element is bound to a substrate, such as a base plate 3, on which the resistive element 2 is extended, and which resistive element is arranged to be placed under the influence of an electrical voltage, by means of electrical conductors not shown in the drawing, see FIG. 1.

Such heating units 1 are used to heat objects such as so called wafers in the electronics manufacturing industry, or as substrate heaters in coating processes, which are located on the base plate. They are used also as panels that emit infrared radiation.

The resistive element 2 and the said base 3, or substrate, have, according to the invention, the same or essentially the same coefficients of thermal expansion. Furthermore, the resistive element 2 has been bound to the substrate 3 through sintering.

Mechanical tension between the layers during manufacture and during use are minimised in that the coefficients of thermal expansion of the two materials are the same or essentially the same, something that is particularly important in the event of repetitative changes in temperature, as occurs in the application of a heating element.

Problems that arise to various extents when the coefficients of thermal expansion of the two materials are different are poor adhesion, buckling and warping of thin and thick metallic layers on the various substrates.

According to one preferred embodiment, the coefficients of thermal expansion of the resistive element and the base plate differ by less than 10%.

According to a further preferred embodiment, the coefficients of thermal expansion of the resistive element and the base plate differ by less than 5%.

The resistive material 2 consists, according to one preferred embodiment, of a Ti—Al—C material or of this material in alloy with Nb, while the base plate 3 at the same time consists of $Al_2O_3$.

The resistive material 2 consists according to a further preferred embodiment of the resistive material $Ti_2AlC$ or of this material in alloy with Nb, namely $Ti_xNb_{2-x}AlC$, while the base plate 3 at the same time consists of $Al_2O_3$.

Both $Al_2O_3$ and $Ti_2AlC$ have a coefficient of thermal expansion of $8\times10^{-6}/°$ K.

X in the formula $Ti_xNb_{2-x}AlC$ lies within the interval 1.8-2.0.

Advantages of using $Ti_2AlC$ or $Ti_xNb_{2-x}AlC$ are the high maximum permitted temperatures at which these materials may be used. These temperatures amount to approximately 1400° C. in oxidising environments, and greater than 1400° C. in oxygen-poor or reducing atmospheres.

The resistive element 2 in the form of a loop with a conducting pattern is bound by lamination and sintered in a subsequent stage to a base plate of $Al_2O_3$, i.e. a cosintered ceramic.

The base plate 3 may be sealing or porous, or it may comprise alternate porous and sealing layers, in order better to withstand thermal cycling from room temperature to 1400° C.

A process known as "tape casting", for example, may be used to apply the conducting pattern. This process proceeds through a tape with a certain width supporting the resistive material in its unsintered but compressed state. The tape in its green condition is applied to the base plate in its green condition, after which the resistive material and the unsintered base plate are pressed together. The materials are subsequently sintered together at a temperature of 1400-1500° C. The tape is vaporised during the sintering process and the resistive material is sintered together with the base plate.

The conducting pattern may be, for example, 0.1-1 mm thick, and each conductor may have a suitable width for the application, a width of, for example, 1-3 mm. The electrical resistance can also be selected to be suitable for the application.

Alternatively, the resistive material in the form of screen printing paste may be applied to insulating layers of $Al_2O_3$. Tapes of thickness 0.1 μm can in this way be laminated to give layers of thickness 1 mm.

Also the layer of $Ti_2AlC$ can be manufactured by the lamination of sealing tape-cast layers of carbide in order to achieve the thickness desired, after which the form of the conducting pattern can be stamped or taken out in another manner from the laminate and will be laminated together with the aluminium oxide layer. This method gives fully sealing materials after the sintering.

The conductive layer is sintered together with the base plate of aluminium oxide.

It is also possible to use other methods of coating such as thermal injection, CVD or PVD.

According to one preferred embodiment, the resistive material 2 can be mixed before sintering with a pre-determined fraction of $Al_2O_3$. The electrical resistance of the resistive material is in this way increased. The fraction of $Al_2O_3$ to be used is determined by the increase in resistance that is desired.

In connection with FIG. 1, an embodiment is shown in which the resistive element 2 is directly exposed to the surroundings. $Ti_2AlC$ has an excellent resistance to oxidation and it forms a layer of $Al_2O_3$ on the surface when heated. This can be used as, for example, a freely radiative heating element up to 1400° C. at the conducting pattern.

According to one preferred embodiment, the resistive element 2 is bound to a further base plate 4 on the opposite side to the said base plate 3, see FIG. 3. The resistive wire thus will be enclosed between two electrical insulators 3, 4. An object, such as an object in the form of a thin disc such as a wafer, can in this way rest directly on the $Al_2O_3$ layer and be heated in this manner.

According to a further preferred embodiment, a laminate may be formed of alternating resistive elements 2 and base plates 4 and 5, where each resistive element 2 is bound to the surrounding base plates that are present on opposite sides, see FIG. 4. The reference number 6 in FIG. 4 denotes a connection unit to connect the resistive elements to a source of voltage.

There can be many layers in a multilayer structure of the type that is illustrated in FIG. 4A, and the number depends on the particular application. For example, components of laminated ceramic circuits can be manufactured through, for example, the preparation of a paste of $Ti_2AlC$ for screen printing and its application by pressure onto an $Al_2O_3$ substrate. According to a further embodiment and as shown in FIG. 4B, a resistive element 2 is located between two base plates 3 divided into two or more sections, which sections are arranged to be controlled individually with respect to the voltage applied.

According to one preferred embodiment, two or more of the resistive elements 2 are connected to each other by means of conductors 7, illustrated with dashed lines in FIGS. 4A, 4B and 4C, that lie perpendicular to the plane of the base plates 3-5 and through the base plates, where the conductors are constituted by resistive material.

A number of embodiments have been described above. A heating element according to the invention may, however, be given another design than that specified above and it may be manufactured by a method other than the methods described above. The resistive element and the electrically insulating aluminium oxide may, for example, be given other designs than plane designs, such as circular designs known as "rod-type" and "tube-type".

Thus, the present invention is not to be considered as being limited to the embodiments specified above, since it can be varied within the scope of the attached patent claims.

The invention claimed is:

1. A heating unit with a resistive element formed as a conducting pattern, which resistive element is bound to a substrate on which the resistive element is extended, and which resistive element is arranged to be placed under the influence of an electrical voltage, wherein the resistive element is bound to a free surface of the substrate by sintering with a first surface of the resistive element in contact with the free surface of the substrate and a second surface of the resistive element opposite the first surface is exposed to the surroundings, wherein the coefficients of thermal expansion of the resistive element and of the substrate differ from each other by less than 10%, and wherein the resistive material consists of a Ti—Al—C material or of a Ti—Al—C material alloyed with Nb, and wherein the substrate consists of $Al_2O_3$.

2. A heating unit according to claim 1, wherein the coefficients of thermal expansion of the resistive element and of the substrate differ from each other by less than 5%.

3. A heating unit according to claim 1, wherein the resistive material consists of $Ti_2AlC$ or of $Ti_2AlC$ alloyed with Nb.

4. A heating unit according to claim 1, wherein the heating unit is a laminate including additional resistive elements and substrates, where opposite first and second surfaces of each additional resistive element are bound to substrates that are present on opposite sides of the additional resistive element.

5. A heating unit according to claim 4, wherein at least one of the additional resistive elements located between two substrates is divided into two or more sections, which sections are arranged to be controlled individually with respect to the voltage applied.

6. A heating unit according to claim 1, wherein the resistive material has been bound to the substrate by sintering of the resistive material to the substrate at a temperature of approximately 1400-1500° C.

7. A heating unit according to claim 4, wherein two or more of the additional resistive elements are connected to each other by means of conductors that run perpendicular to the plane of the substrates and through the substrates, where the conductors are constituted by resistive material.

8. A heating unit according to claim 6, wherein the resistive material has been mixed with a pre-determined fraction of $Al_2O_3$ before sintering.

9. A heating unit according to claim 3, wherein $Ti_2AlC$ alloyed with Nb is $Ti_xNb_{2-x}AlC$, where X lies within the interval 1.8-2.0.

10. A heating unit according to claim 1, wherein the substrate is a base plate.

* * * * *